US010533306B2

(12) United States Patent
Sherlock

(10) Patent No.: US 10,533,306 B2
(45) Date of Patent: Jan. 14, 2020

(54) JOINT WEAR DEVICE FOR A WORK VEHICLE

(71) Applicant: Deere & Company, Moline, IL (US)

(72) Inventor: Lance R. Sherlock, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 74 days.

(21) Appl. No.: 15/800,721

(22) Filed: Nov. 1, 2017

(65) Prior Publication Data

US 2019/0127958 A1 May 2, 2019

(51) Int. Cl.
*E02F 9/26* (2006.01)
*E02F 3/32* (2006.01)

(52) U.S. Cl.
CPC ..... *E02F 9/267* (2013.01); *E02F 3/32* (2013.01); *E02F 9/268* (2013.01)

(58) Field of Classification Search
CPC ..... E02F 9/264; E02F 3/30; E02F 9/26; E02F 9/267; E02F 3/845; E02F 9/2221; E02F 9/24; E02F 9/265; E02F 9/268
See application file for complete search history.

(56) References Cited

U.S. PATENT DOCUMENTS 4,044,610 A * 8/1977 Oldaeus ..... E02F 3/30 172/430
4,470,635 A * 9/1984 Paurat ..... E21D 9/102 173/4
4,752,012 A * 6/1988 Juergens ..... B66C 23/905 212/277
4,809,794 A * 3/1989 Blair ..... E02F 3/30 177/139
6,865,464 B2 * 3/2005 Colburn ..... E02F 9/264 701/50
6,934,616 B2 * 8/2005 Colburn ..... E02F 3/435 37/414
7,908,928 B2 3/2011 Vik et al.
(Continued)

FOREIGN PATENT DOCUMENTS

DE 3035543 A1 * 5/1982 ..... E02F 3/30
JP 2014163047 A 9/2014
WO 2016115499 A1 7/2016

OTHER PUBLICATIONS

German Search Report issued in counterpart application No. 102018216718.4 dated Jun. 28, 2019. (10 pages).

*Primary Examiner* — David A Rogers

(57) ABSTRACT

A work vehicle comprises a swingable body. The swingable body is coupled to an undercarriage by a body joint. A boom is coupled to the swingable body by a boom joint. An arm is coupled to the boom by an arm joint. An implement is coupled to the arm by an implement joint. The work vehicle comprises a joint wear device that comprises a first sensor coupled to the swingable body and configured for generating a first signal indicative of an acceleration of the swingable body during a swing motion. A second sensor is coupled to at least one of the boom, the arm, and the implement and configured for generating a second signal indicative of an acceleration of at least one of the boom, the arm, and the implement, respectively, during the swing motion. A controller is coupled to the work vehicle and configured for generating a wear signal.

19 Claims, 2 Drawing Sheets

(56) References Cited

U.S. PATENT DOCUMENTS

| | | | | |
|---|---|---|---|---|
| 8,600,611 | B2 * | 12/2013 | Seize | G01M 5/0033 701/31.1 |
| 9,285,389 | B2 * | 3/2016 | Salsman | G01P 15/18 |
| 9,371,630 | B1 * | 6/2016 | Johannsen | G07C 5/0808 |
| 9,670,649 | B2 * | 6/2017 | Bewley | E02F 9/2816 |
| 9,671,314 | B2 * | 6/2017 | Followell | G01M 1/125 |
| 2004/0025595 | A1 * | 2/2004 | Brennan | G01M 5/0033 73/787 |
| 2004/0078170 | A1 * | 4/2004 | Di Marzio | G08C 17/02 702/188 |
| 2004/0260512 | A1 * | 12/2004 | Olsson | G01M 13/021 702/182 |
| 2005/0021245 | A1 * | 1/2005 | Furuno | E02F 9/205 702/33 |
| 2009/0222176 | A1 * | 9/2009 | Florean | E02F 3/432 701/50 |
| 2010/0013594 | A1 * | 1/2010 | Komine | G05B 19/0428 340/5.8 |
| 2010/0100338 | A1 * | 4/2010 | Vik | G01M 5/0033 702/42 |
| 2010/0312436 | A1 * | 12/2010 | Hartwig | B60T 8/1766 701/50 |
| 2014/0244101 | A1 * | 8/2014 | Chitty | E02F 9/2054 701/31.6 |
| 2015/0253151 | A1 | 9/2015 | Inberg et al. | |
| 2015/0322634 | A1 * | 11/2015 | Stock | E02F 3/20 299/39.4 |
| 2016/0376771 | A1 * | 12/2016 | Behmlander | E02F 9/26 37/453 |
| 2017/0107700 | A1 * | 4/2017 | Faivre | E02F 9/2029 |
| 2017/0275854 | A1 | 9/2017 | Izumikawa | |
| 2018/0073945 | A1 * | 3/2018 | Kai | E02F 9/20 |
| 2018/0373966 | A1 * | 12/2018 | Beschorner | G06K 9/6293 |

* cited by examiner

JOINT WEAR DEVICE FOR A WORK VEHICLE

FIELD OF THE DISCLOSURE

The present disclosure generally relates to work vehicles, and more particularly to a joint wear device for a work vehicle.

BACKGROUND OF THE DISCLOSURE

In order to check wear on a joint of a work vehicle, a visual inspection is commonly required for work vehicles.

SUMMARY OF THE DISCLOSURE

In one embodiment, a joint wear device for a work vehicle is disclosed. The work vehicle has a swingable body coupled to an undercarriage by a body joint. A boom is coupled to the swingable body by a boom joint. An arm is coupled to the boom by an arm joint. An implement is coupled to the arm by an implement joint. The joint wear device comprises a first sensor coupled to the swingable body of the work vehicle and configured for generating a first signal indicative of an acceleration of the swingable body during a swing motion. A second sensor is coupled to the boom of the work vehicle and configured for generating a second signal indicative of an acceleration of the boom during the swing motion. A third sensor is coupled to the arm of the work vehicle and configured for generating a third signal indicative of an acceleration of the arm during the swing motion. A fourth sensor is coupled to the implement of the work vehicle and configured for generating a fourth signal indicative of an acceleration of the implement during the swing motion. A controller is coupled to the work vehicle and configured for receiving the first, second, third, and fourth signals, and generating a wear signal based on a comparison of the first, second, third, and fourth signals.

In another embodiment, a work vehicle is disclosed. The work vehicle comprises a swingable body. The swingable body is coupled to an undercarriage by a body joint. A boom is coupled to the swingable body by a boom joint. An arm is coupled to the boom by an arm joint. An implement is coupled to the arm by an implement joint. The work vehicle comprises a joint wear device. The joint wear device comprises a first sensor coupled to the swingable body and configured for generating a first signal indicative of an acceleration of the swingable body during a swing motion. A second sensor is coupled to at least one of the boom, the arm, and the implement and configured for generating a second signal indicative of an acceleration of at least one of the boom, the arm, and the implement, respectively, during the swing motion. A controller is coupled to the work vehicle and configured for receiving the first signal and the second signal, and generating a wear signal indicative of wear of at least one of the body joint, the boom joint, the arm joint, and the implement joint based on a ratio of the first signal and the second signal.

In yet another embodiment, a work vehicle is disclosed. The work vehicle comprises a swingable body. The swingable body is coupled to an undercarriage by a body joint. A first pin secures the swingable body to the undercarriage and is received by the body joint. A boom is coupled to the swingable body by a boom joint. A second pin secures the boom to the swingable body and is received by the boom joint. An arm is coupled to the boom by an arm joint. A third pin secures the arm to the boom and is received by the arm joint. An implement is coupled to the arm by an implement joint. A fourth pin secures the implement to the arm and is received by the implement joint. The work vehicle comprises a joint wear device comprising a first sensor coupled to the swingable body and configured for generating a first signal indicative of an acceleration of the swingable body during a swing motion. A second sensor is coupled to the boom and configured for generating a second signal indicative of an acceleration of the boom during the swing motion. A third sensor is coupled to the arm and configured for generating a third signal indicative of an acceleration of the arm during the swing motion. A fourth sensor is coupled to the implement and configured for generating a fourth signal indicative of an acceleration of the implement during the swing motion. A controller is coupled to the work vehicle and configured for receiving the first, second, third, and fourth signals, and generating a wear signal indicative of wear of at least one of the body joint, the boom joint, the arm joint, the implement joint, the first pin, the second pin, the third pin, and the fourth pin, based on a comparison of the first, second, third, and fourth signals, wherein the wear signal is indicative of when the comparison of the first, second, third, and fourth signals exceeds a threshold.

Other features and aspects will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Further embodiments of the invention may include any combination of features from one or more dependent claims, and such features may be incorporated, collectively or separately, into any independent claim.

DETAILED DESCRIPTION

Figure 1:
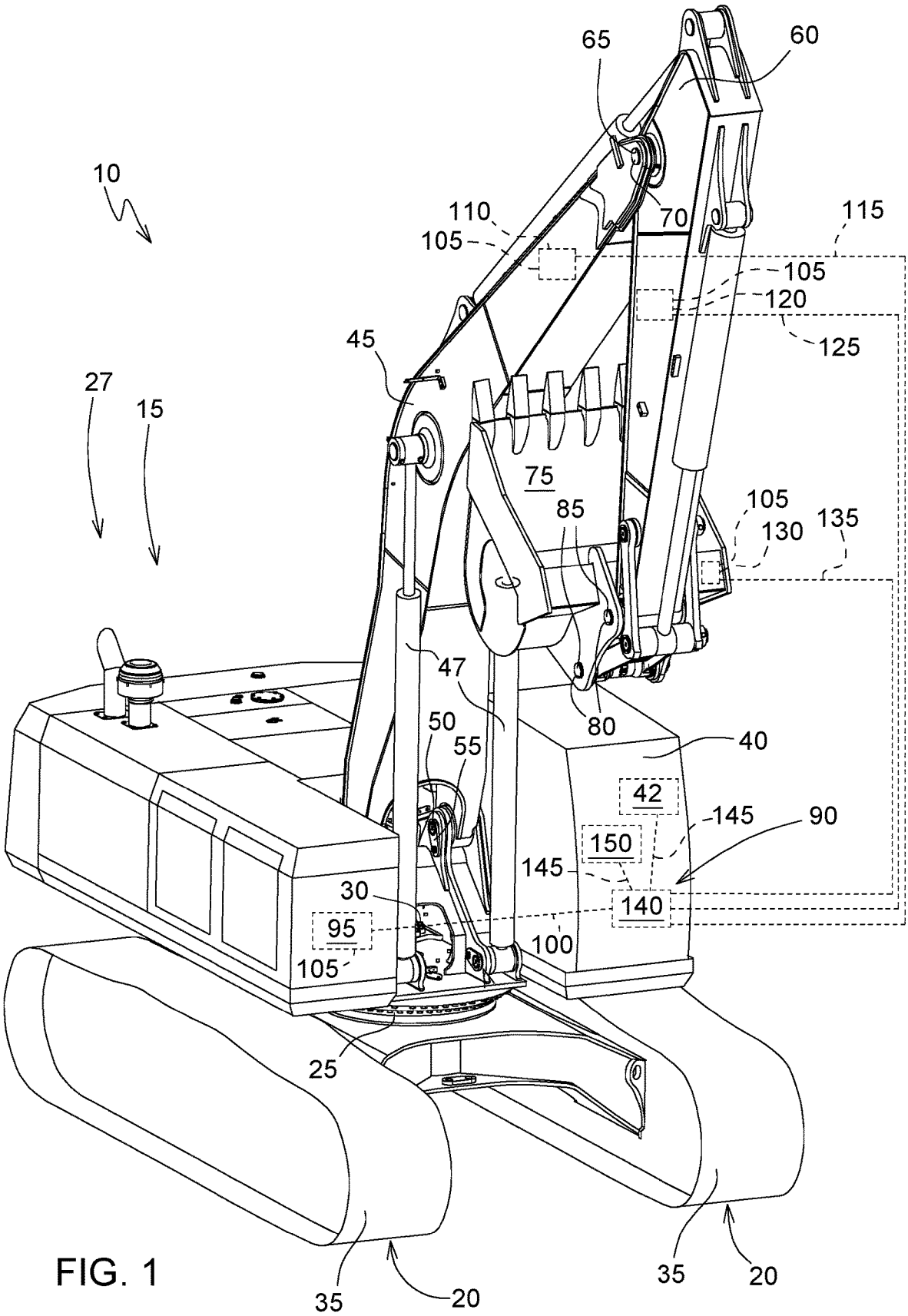
FIG. 1 is a perspective view of a work vehicle according to one embodiment.

FIG. 1 illustrates a work vehicle 10 having a swingable body 15 coupled to an undercarriage 20 by a body joint 25. The illustrated work vehicle 10 is an excavator 27. Other work vehicles 10 are contemplated by this disclosure. The body joint 25 may include a roller bearing, bushing, or other device. At least one first pin 30 is received by the body joint 25 and secures the swingable body 15 to the undercarriage 20. The undercarriage 20 is configured to support and provide mobility for the swingable body 15 on a surface. The illustrated undercarriage 20 is a pair of endless tracks 35. Alternatively, the undercarriage 20 may be a plurality of wheels (not shown).

Figure 2:
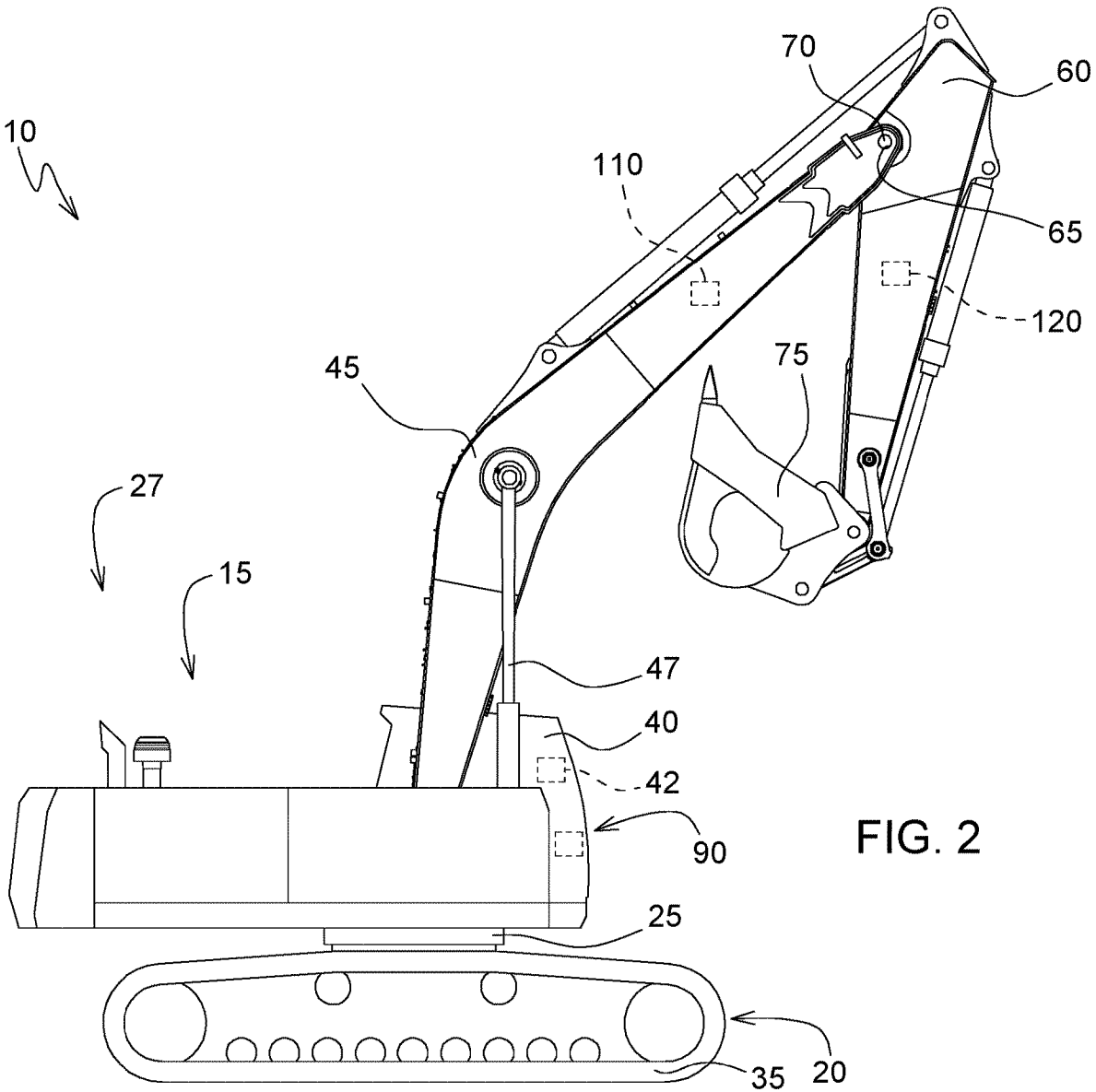
FIG. 2 is a side view of the work vehicle of FIG. 1.

With reference to FIG. 2, an operator's station 40 is coupled to the swingable body 15. The operator's station 40 may include a control system 42 for operating the work vehicle 10. The control system 42 may include one or more touch screens, buttons, knobs, joysticks, or other input devices.

Referring to FIGS. 1 and 2, a boom 45 is coupled to the swingable body 15 by a boom joint 50 (FIG. 1). The boom joint 50 may include a roller bearing, bushing, or other device. At least one second pin 55 is received by the boom joint 50 and secures the boom 45 to the swingable body 15. Movement of the boom 45 may be controlled by the control system 42 using hydraulic cylinders 47 or other actuators.

An arm 60 is coupled to the boom 45 by an arm joint 65. The arm joint 65 may include a roller bearing, bushing, or other device. At least one third pin 70 is received by the arm joint 65 and secures the arm 60 to the boom 45.

An implement 75 is coupled to the arm 60 by an implement joint 80. The implement joint 80 may include a roller bearing, bushing, or other device. At least one fourth pin 85 is received by the implement joint 80 and secures the implement 75 to the arm 60. The implement 75 may be a bucket, air hammer, or other device.

The work vehicle 10 includes a joint wear device 90. The joint wear device 90 comprises a first sensor 95 coupled to the swingable body 15 of the work vehicle 10 and configured for generating a first signal 100 indicative of an acceleration of the swingable body 15 during a swing motion. The acceleration may be linear or angular. The first sensor 95 may be an inertial measurement unit ("IMU") 105 configured for measuring acceleration in the x, y, and z directions. The first signal 100 may be indicative of acceleration in the x, y, or z direction.

A second sensor 110 is coupled to the boom 45 of the work vehicle 10 and is configured for generating a second signal 115 indicative of an acceleration of the boom 45 during the swing motion. The acceleration may be linear or angular. The second sensor 110 may be an inertial measurement unit ("IMU") 105 configured for measuring acceleration in the x, y, and z directions. The second signal 115 may be indicative of acceleration in the x, y, or z direction.

A third sensor 120 is coupled to the arm 60 of the work vehicle 10 and is configured for generating a third signal 125 indicative of an acceleration of the arm 60 during the swing motion. The acceleration may be linear or angular. The third sensor 120 may be an inertial measurement unit ("IMU") 105 configured for measuring acceleration in the x, y, and z directions. The third signal 125 may be indicative of acceleration in the x, y, or z direction.

A fourth sensor 130 is coupled to the implement 75 of the work vehicle 10 and is configured for generating a fourth signal 135 indicative of an acceleration of the implement 75 during the swing motion. The acceleration may be linear or angular. The fourth sensor 130 may be an inertial measurement unit ("IMU") 105 configured for measuring acceleration in the x, y, and z directions. The fourth signal 135 may be indicative of acceleration in the x, y, or z direction.

A controller 140 is coupled to the work vehicle 10 and is configured for receiving the first signal 100, the second signal 115, the third signal 125, and the fourth signal 135, and generating a wear signal 145 based on a comparison of the first signal 100, the second signal 115, the third signal 125, and the fourth signal 135. The comparison may be a ratio of one of the first signal 100, the second signal 115, the third signal 125, and the fourth signal 135 with another of the first signal 100, the second signal 115, the third signal 125, and the fourth signal 135. Alternatively, the comparison may be a proportionality calculation over time.

The first signal 100, the second signal 115, the third signal 125, and the fourth signal 135 may be communicated over a controller area network (CAN) bus (or another network, such as an Ethernet network, WiFi etc.) to various systems that process the sensed variables to generate output signals (such as the wear signal 145, other control signals, or other outputs) based on the sensed variables.

The wear signal 145 may be indicative of wear of at least one of the body joint 25, the boom joint 50, the arm joint 65, the implement joint 80, the first pin 30, the second pin 55, the third pin 70, and the fourth pin 85. The wear signal 145 may indicate when the wear at least one of equals and exceeds a threshold. The wear signal 145 may also indicate how much wear has occurred and a threshold. The wear signal 145 may be received by the control system 42 and when the wear signal 145 at least one of equals and exceeds the threshold, an automated grade control 150 may be turned off. Automated grade control 150 is a feature that automatically controls the boom 45, the arm 60, and the implement 75 to achieve a desired grade or feature of the surface. Alternatively, an alarm, a flashing light, or other audible, visual, or tactile indicator may be provided to alert an operator in the operator's station 40 that a threshold is being approached, reached, or exceeded. An estimate of when the threshold might be reached may also be provided to the operator based in part on average work vehicle 10 usage.

Various features are set forth in the following claims.

What is claimed is:

1. A joint wear device for a work vehicle having a swingable body coupled to an undercarriage by a body joint, a boom coupled to the swingable body by a boom joint, an arm coupled to the boom by an arm joint, and an implement coupled to the arm by an implement joint, the joint wear device comprising:

a first sensor coupled to the swingable body of the work vehicle and configured for generating a first signal indicative of an acceleration of the swingable body during a swing motion;

a second sensor coupled to the boom of the work vehicle and configured for generating a second signal indicative of an acceleration of the boom during the swing motion;

a third sensor coupled to the arm of the work vehicle and configured for generating a third signal indicative of an acceleration of the arm during the swing motion;

a fourth sensor coupled to the implement of the work vehicle and configured for generating a fourth signal indicative of an acceleration of the implement during the swing motion; and a controller coupled to the work vehicle and configured for:

receiving the first, second, third, and fourth signals;

generating a wear signal based on a comparison of the first, second, third, and fourth signals; and generating an alarm in the operator's station when the wear signal indicates the wear at least one of equals and exceeds a threshold.

2. The joint wear device of claim 1, wherein the first sensor, the second sensor, the third sensor, and the fourth sensor are inertial measurement units configured for measuring acceleration in the x, y, and z directions.

3. The joint wear device of claim 2, wherein the first, second, third, and fourth signals are indicative of acceleration in the z direction.

4. The joint wear device of claim 1, wherein the wear signal is indicative of a wear of at least one of the body joint, the boom joint, the arm joint, and the implement joint.

5. The joint wear device of claim 1, further comprising a first pin securing the swingable body to the undercarriage and received by the body joint, a second pin securing the boom to the swingable body and received by the boom joint, a third pin securing the arm to the boom and received by the arm joint, and a fourth pin securing the implement to the arm and received by the implement joint.

6. The joint wear device of claim 5, wherein the wear signal is indicative of wear of at least one of the first pin, the second pin, the third pin, and the fourth pin.

7. The joint wear device of claim 1, wherein the wear signal indicates how much wear has occurred and a threshold.

8. The joint wear device of claim 7, wherein when the wear signal at least one of equals and exceeds the threshold, an automated grade control is turned off.

9. A work vehicle comprising:

a swingable body coupled to an undercarriage by a body joint;

a boom coupled to the swingable body by a boom joint;

an arm coupled to the boom by an arm joint;

an implement coupled to the arm by an implement joint; and a joint wear device comprising:

a first sensor coupled to the swingable body and configured for generating a first signal indicative of an acceleration of the swingable body during a swing motion;

a second sensor coupled to at least one of the boom, the arm, and the implement and configured for generating a second signal indicative of an acceleration of at least one of the boom, the arm, and the implement, respectively, during the swing motion; and a controller coupled to the work vehicle and configured for:

receiving the first signal and the second signal;

generating a wear signal based on a ratio of the first signal and the second signal; and generating an alarm in the operator's station when the wear signal indicates the wear at least one of equals and exceeds a threshold.

10. The work vehicle of claim 9, wherein the first sensor and the second sensor are inertial measurement units configured for measuring acceleration in the x, y, and z directions.

11. The work vehicle of claim 10, wherein the first and second signals are indicative of acceleration in the z direction.

12. The work vehicle of claim 9, wherein the wear signal is indicative of a wear of at least one of the body joint, the boom joint, the arm joint, and the implement joint.

13. The work vehicle of claim 9, further comprising a first pin securing the swingable body to the undercarriage and received by the body joint, a second pin securing the boom to the swingable body and received by the boom joint, a third pin securing the arm to the boom and received by the arm joint, and a fourth pin securing the implement to the arm and received by the implement joint.

14. The work vehicle of claim 13, wherein the wear signal is indicative of wear of at least one of the first pin, the second pin, the third pin, and the fourth pin.

15. The work vehicle of claim 9, wherein an automated grade control is turned off when the wear signal at least one of equals and exceeds a threshold.

16. A work vehicle comprising:

a swingable body coupled to an undercarriage by a body joint;

a first pin securing the swingable body to the undercarriage and received by the body joint;

a boom coupled to the swingable body by a boom joint;

a second pin securing the boom to the swingable body and received by the boom joint;

an arm coupled to the boom by an arm joint;

a third pin securing the arm to the boom and received by the arm joint;

an implement coupled to the arm by an implement joint;

a fourth pin securing the implement to the arm and received by the implement joint; and a joint wear device comprising:

a first sensor coupled to the swingable body and configured for generating a first signal indicative of an acceleration of the swingable body during a swing motion;

a second sensor coupled to the boom and configured for generating a second signal indicative of an acceleration of the boom during the swing motion;

a third sensor coupled to the arm and configured for generating a third signal indicative of an acceleration of the arm during the swing motion;

a fourth sensor coupled to the implement and configured for generating a fourth signal indicative of an acceleration of the implement during the swing motion; and a controller coupled to the work vehicle and configured for:

receiving the first, second, third, and fourth signals;

generating a wear signal based on a comparison of the first, second, third, and fourth signals, the wear signal indicative of wear of at least one of the body joint, the boom joint, the arm joint, the implement joint, the first pin, the second pin, the third pin, and the fourth pin, wherein the wear signal is indicative of when the comparison of the first, second, third, and fourth signals exceeds a threshold; and generating an alarm in the operator's station when the wear signal indicates the wear at least one of equals and exceeds a threshold.

17. The work vehicle of claim 16, wherein the first sensor, the second sensor, the third sensor, and the fourth sensor are inertial measurement units configured for measuring acceleration in the x, y, and z directions.

18. The work vehicle of claim 17, wherein the first, second, third, and fourth signals are indicative of acceleration in the z direction.

19. The work vehicle of claim 16, wherein an automated grade control is turned off when the wear signal at least one of equals and exceeds a threshold.

* * * * *